US005484089A

United States Patent [19]

Picerno

[11] Patent Number: 5,484,089

[45] Date of Patent: Jan. 16, 1996

[54] PILL BOTTLE AND DISPENSING CAP COMBINATION

[76] Inventor: Virginia L. Picerno, 1201 Grand River Dr., Sacramento, Calif. 95831

[21] Appl. No.: 344,025

[22] Filed: Nov. 23, 1994

[51] Int. Cl.[6] ..... B67D 3/00

[52] U.S. Cl. ..... 222/534; 222/536

[58] Field of Search ..... 222/531, 532, 222/537, 534, 536, 556, 568

[56] References Cited

U.S. PATENT DOCUMENTS

| | | | |
|---|---|---|---|
| 3,089,626 | 5/1963 | Kubiliunas | 222/536 |
| 4,282,991 | 8/1981 | Hazard | 222/536 |
| 4,756,451 | 7/1988 | Wilson | 222/534 |
| 5,190,176 | 3/1993 | Lavange | 222/534 |

*Primary Examiner*—William A. Cuchlinski, Jr.
*Assistant Examiner*—Philippe Derakshani

[57] ABSTRACT

A pill bottle and dispensing cap combination comprising a pill bottle having a tubular side wall with inwardly flared upper and lower end portions, a bottom wall integral with the lower end portion, and a mouth with outwardly projecting threads extended from the upper end portion and defining an opening; a dispensing cap including a cap portion and an elongated nozzle, the cap portion having a circular top wall including an annular side wall with inwardly projecting threads extended downwards therefrom, the top wall further including a channel disposed thereon and a pair of opposed seats formed in the channel, the cap portion further having an aperture disposed within the channel at a location between the seats, the cap portion threadedly coupled to the mouth of the pill bottle with the aperature thereof in communication with the opening, the nozzle having a base end with a base opening disposed thereon, a sealed tip end, a tip opening thereon near the tip end, and a pair of opposed plugs extended outwards therefrom with each plug rotatably disposed within a separate seat of the cap portion.

2 Claims, 4 Drawing Sheets

PILL BOTTLE AND DISPENSING CAP COMBINATION

BACKGROUND OF THE INVENTION

1. Field of the Invention

The present invention relates to a pill bottle and dispensing cap combination and more particularly pertains to allowing an individual to readily dispense pills and the like for use with a pill bottle and dispensing cap combination.

2. Description of the Prior Art

The use of dispensing bottles and caps is known in the prior art. More specifically, dispensing bottles and caps heretofore devised and utilized for the purpose of dispensing items for use are known to consist basically of familiar, expected and obvious structural configurations, notwithstanding the myriad of designs encompassed by the crowded prior art which have been developed for the fulfillment of countless objectives and requirements.

By way of example, U.S. Pat. Des. No. 324,998 to Klapwald discloses a combined bottle and dispensing cap. U.S. Pat. Des. No. 307,709 to Liss discloses a bottle and dispensing cap. U.S. Pat. No. 3,601,250 to Merlin discloses a dispensing cap for pill bottles. U.S. Pat. No. 4,432,300 to Lyss discloses a pill dispenser and sequential dispenser and indicating cap. U.S. Pat. No. 4,934,543 to Schmidt discloses a bottle cap and dispenser.

While these devices fulfill their respective, particular objective and requirements, the aforementioned patents do not describe a pill bottle and dispensing cap combination that allows pills and the like to be readily dispensed therefrom and is ideally suited for use by those who have difficulty opening conventional bottles or safety caps.

In this respect, the pill bottle and dispensing cap combination according to the present invention substantially departs from the conventional concepts and designs of the prior art, and in doing so provides an apparatus primarily developed for the purpose of allowing an individual to readily dispense pills and the like for use.

Therefore, it can be appreciated that there exists a continuing need for new and improved pill bottle and dispensing cap combination which can be used for allowing an individual to readily dispense pills and the like for use. In this regard, the present invention substantially fulfills this need.

SUMMARY OF THE INVENTION

In the view of the foregoing disadvantages inherent in the known types of dispensing bottles and caps now present in the prior art, the present invention provides an improved pill bottle and dispensing cap combination. As such, the general purpose of the present invention, which will be described subsequently in greater detail, is to provide a new and improved pill bottle and dispensing cap combination and method which has all the advantages of the prior art and none of the disadvantages.

To attain this, the present invention essentially comprises, in combination, a plastic pill bottle. The pill bottle has a tubular side wall with an integral inwardly flared annular curved upper end portion and an integral inwardly flared annular curved lower end portion. The radius of curvature of the upper end portion is greater than the radius of curvature of the lower end portion. The pill bottle has circular planar bottom wall integral with the lower end portion and axially aligned with the side wall. The pill bottle has a tubular mouth with outwardly projecting threads disposed thereon.

The mouth has a top end and a bottom end with the bottom end integral with the upper end portion of the side wall and axially aligned with the side wall. The mouth defines a central opening for allowing items to be disposed within the pill bottle.

A plastic dispensing cap is provided. The dispensing cap includes a cap portion and an elongated nozzle. The cap portion has a circular planar top wall with an upper surface, a lower surface, and a peripheral outer edge interconnecting the upper surface with the lower surface. The cap portion has an annular side wall including an outer surface, an inner surface with a plurality of inwardly projecting threads disposed therearound, a top end, and a bottom end with the top end integral and perpendicular with the outer edge of the top wall such that the side wall is axially aligned with the top wall. The top wall further includes an elongated diametrically aligned channel disposed thereon. The channel defines a planar horizontal base surface, a pair of opposed and spaced upstanding inner side surfaces with the side surfaces extended between the base surface and upper surface of the top wall, an upstanding first end surface extended between the side surfaces and base surface at one end of the channel, and a second end surface extended between the side surfaces and the base surface at the other end of the channel. The second end surface includes an upstanding lower end surface portion and an outwardly flared upper end surface portion and with the upper end surface portion and the adjacent side surfaces defining a shallow slot. A pair of opposed seats are included with each seat disposed on a side surface at a location near the first end surface and with each seat including a frustral recessed portion and an vertical outwardly tapered groove having a trapezoidal cross-section. Each groove is extended from a seat to the upper surface of the top wall. The cap portion further includes a rectangular aperture disposed on the base surface of the channel at a location between the seats. The cap portion is threadedly coupled to the mouth of the pill bottle with the aperature thereof in communication with the central opening.

The nozzle has an upper wall with a planar upper surface, a lower wall, and pair of opposed spaced side walls perpendicularly interconnected therebetween. The nozzle also has rounded base end with a base opening disposed thereon, a sealed tip end, and an intermediate location defined between the base end and the tip end. The nozzle includes hollow base portion with a rectangular cross-section tapering inwards from the base end to the intermediate location and a hollow tip portion having a rectangular cross-section tapering outwards from the intermediate location to the tip end. A tip opening is disposed on the lower surface with the tip opening formed of a generally rectangular first section located on the base portion and a generally rectangular second section located on the tip portion. A planar rectangular lip is projected outwards from the tip end and aligned in parallel with the upper wall of the tip portion. Lastly the nozzle includes a pair of opposed axially aligned frustral plugs extended outwards from the side surfaces of the lower portion near the base end. Each plug is disposed within a recessed portion of a separate seat for rotatable movement therein. The nozzle is positionable in a closed orientation within the channel with its upper surface flush with the upper surface of the cap portion and with its lip is positioned in the slot of the cap portion for precluding communication between its base opening and the aperture of the cap portion, thereby preventing items disposed within the pill bottle from being dispensed through the tip opening of the nozzle. The nozzle is further positionable in an open orientation with its base opening in communication with the aperture of the cap portion and the central opening of the pill bottle, thereby allowing items disposed within the pill bottle to be dispensed through the tip opening of the nozzle.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved pill bottle and dispensing cap combination which has all the advantages of the prior art dispensing bottles and caps and none of the disadvantages.

It is another object of the present invention to provide a new and improved pill bottle and dispensing cap combination which may be easily and efficiently manufactured and marketed.

It is a further object of the present invention to provide a new and improved pill bottle and dispensing cap combination which is of durable and reliable construction.

An even further object of the present invention is to provide a new and improved pill bottle and dispensing cap combination which is susceptible of a low cost of manufacture with regard to both materials and labor, and which accordingly is then susceptible of low prices of sale to the consuming public, thereby making such a pill bottle and dispensing cap combination economically available to the buying public.

Still yet another object of the present invention is to provide a new and improved pill bottle and dispensing cap combination which provides in the apparatuses and methods of the prior art some of the advantages thereof, while simultaneously overcoming some of the disadvantages normally associated therewith.

Even still another object of the present invention is to provide a new and improved pill bottle and dispensing cap combination for allowing an individual to readily dispense pills and the like for use.

Lastly, it is an object of the present invention to provide a new and improved pill bottle and dispensing cap combination comprising a pill bottle having a generally tubular side wall with an inwardly flared upper end portion and an inwardly flared lower end portion, a bottom wall integral with the lower end portion, and a mouth with outwardly projecting threads extended from the upper end portion and defining an opening; a dispensing cap including a cap portion and a nozzle portion, the cap portion having a circular top wall including an annular side wall with inwardly projecting threads extended downwards therefrom, the top wall further including a channel disposed thereon and a pair of opposed seats formed in the channel, the cap portion further having an aperture disposed within the channel at a location between the seats, the cap portion threadedly coupled to the mouth of the pill bottle with the aperature thereof in communication with the opening; and an elongated nozzle having a base end with a base opening disposed thereon, a sealed tip end, a tip opening disposed thereon near the tip end, and a pair of opposed plugs extended outwards therefrom with each plug disposed within a separate seat of the cap portion for rotatable movement therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
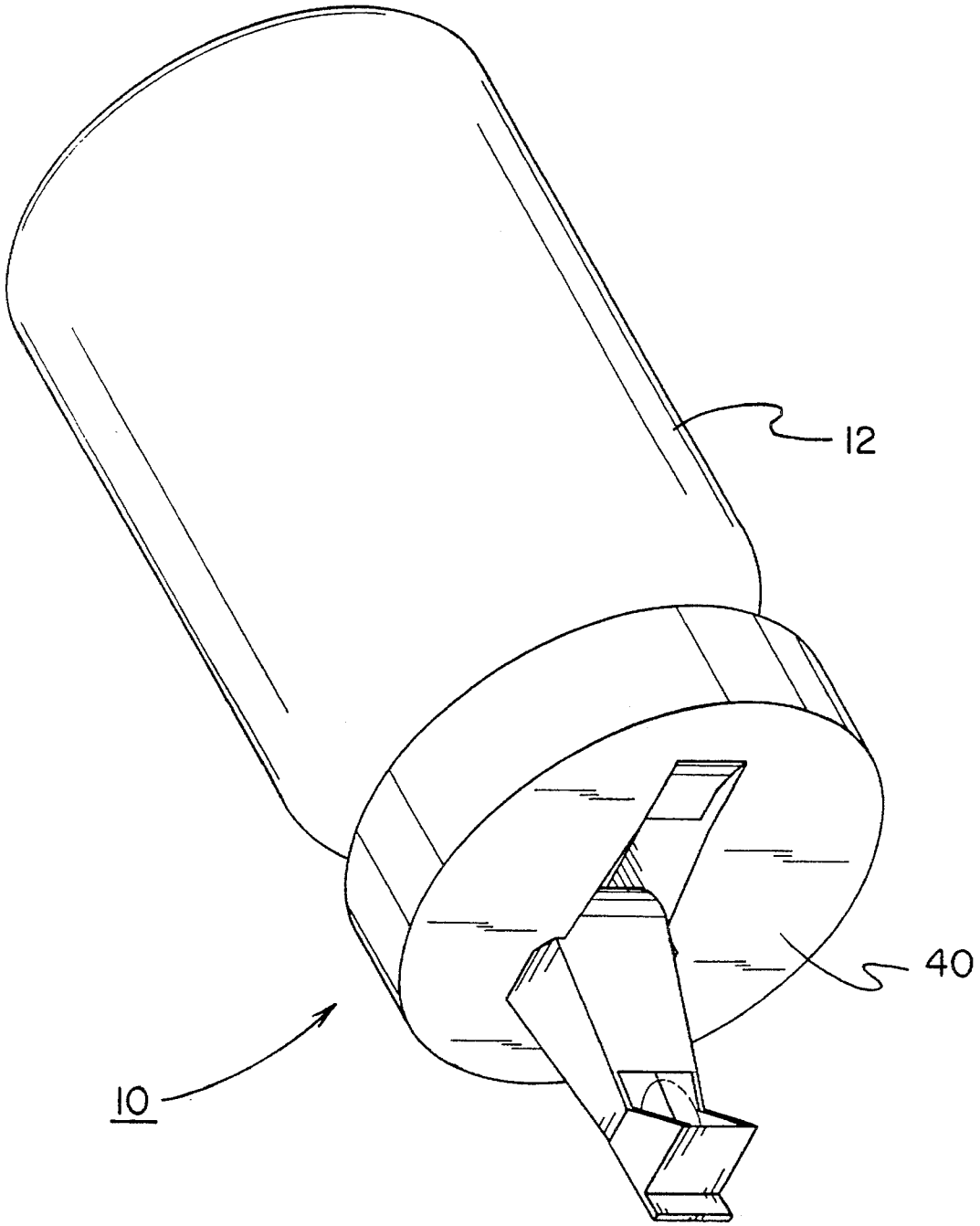
FIG. 1 is a perspective view of the preferred embodiment of the pill bottle and dispensing cap combination constructed in accordance with the principles of the present invention.
Figure 2:
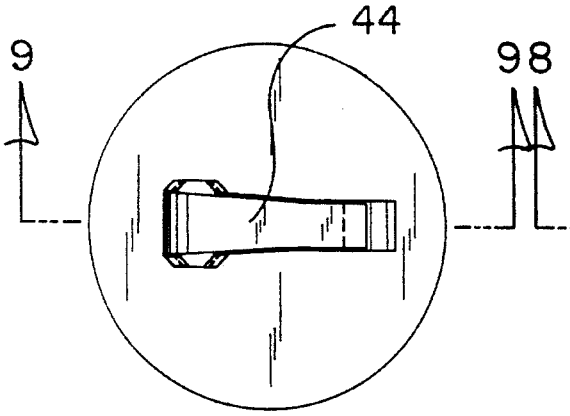
FIG. 2 is a plan view of the present invention with its nozzle in a closed orientation.
Figure 3:
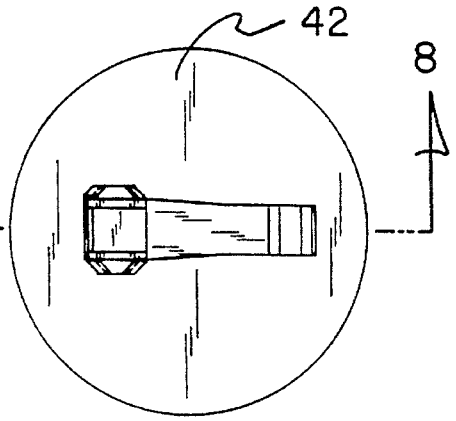
FIG. 3 is yet another plan view of the present invention with its nozzle in an opened orientation.
Figure 4:
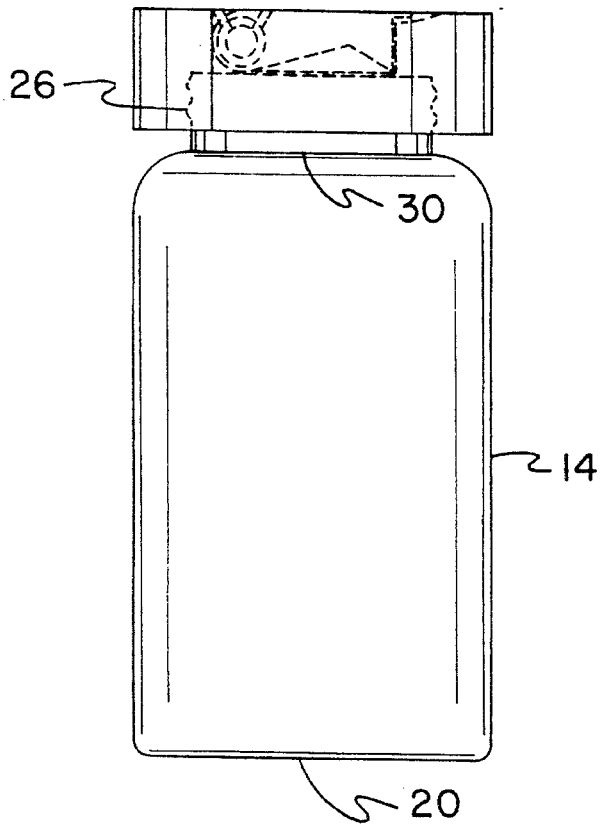
FIG. 4 is a side elevational view of the present invention with its nozzle in a closed orientation.
Figure 5:
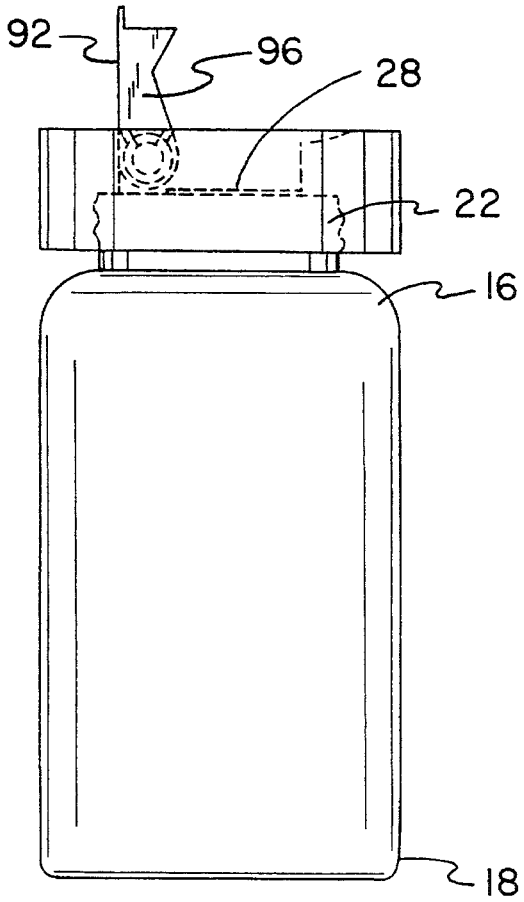
FIG. 5 is yet another side elevational view of the present invention with its nozzle in an open orientation.
Figure 6:
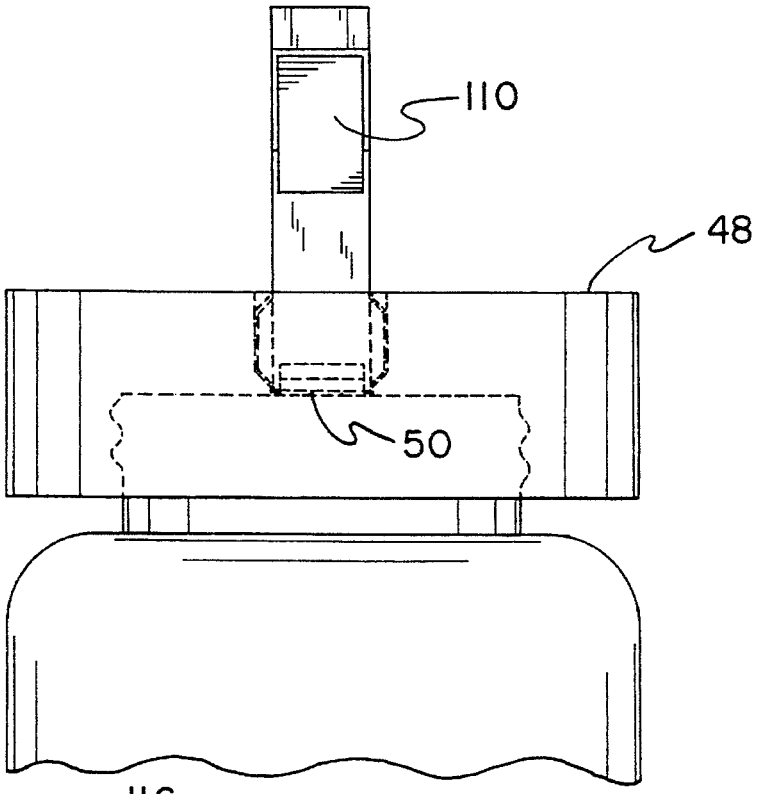
FIG. 6 is an enlarged sectional view of the coupling of the pill bottle with the dispensing cap.
Figure 7:
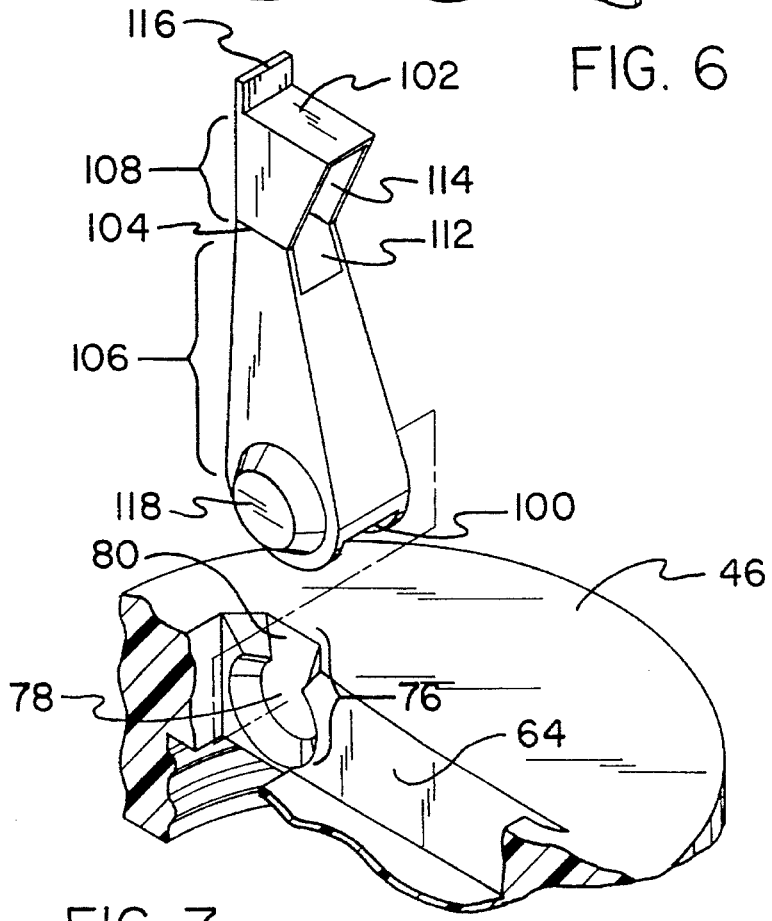
FIG. 7 is an exploded sectional view depicting the rotatable coupling between the nozzle and the cap portion.
Figure 8:
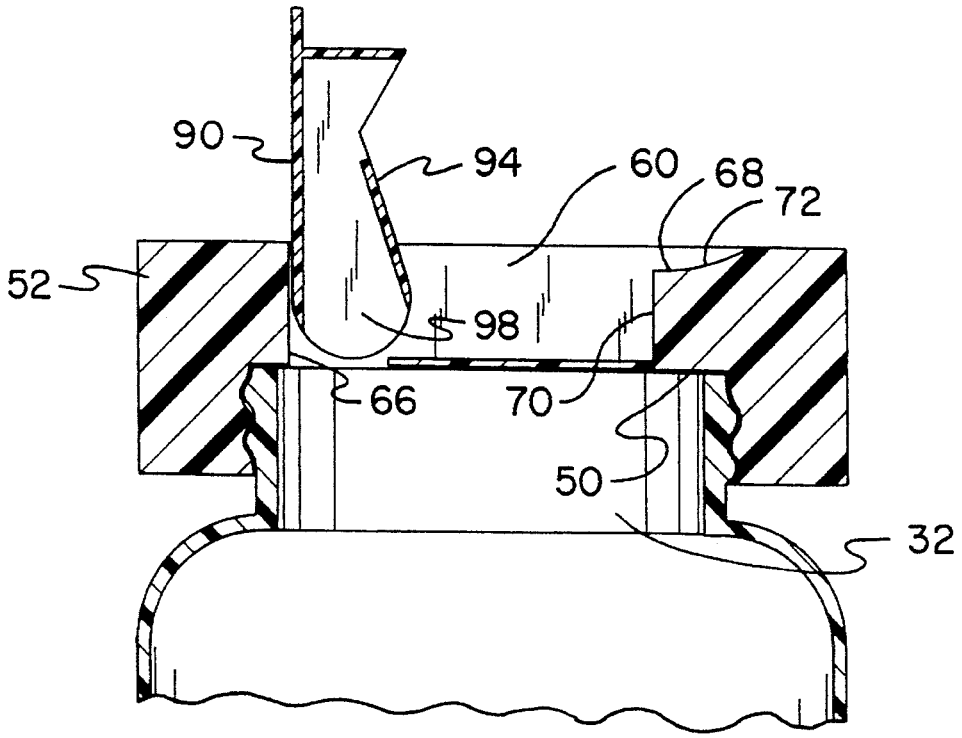
FIG. 8 is a cross-sectional view of the present invention taken along the line 8—8 of FIG. 3.
Figure 9:
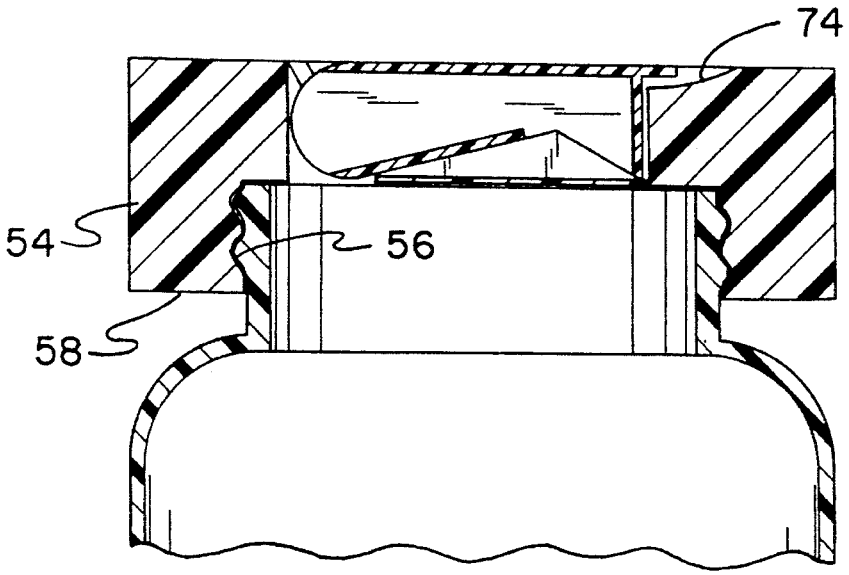
FIG. 9 is a cross-sectional view of the present invention taken along the line 9—9 of FIG. 2.

With reference now to the drawings, and in particular, to FIG. 1 thereof, the preferred embodiment of the new and improved pill bottle and dispensing cap combination embodying the principles and concepts of the present invention and generally designated by the reference number 10 will be described.

The present invention is comprised of a plurality of components. In their broadest context, these components include a pill bottle and a dispensing cap. Such components are individually configured and correlated with respect to each other to provide the intended function of allowing an individual to readily dispense pills and the like for use.

Specifically, the present invention includes a pill bottle 12. The pill bottle is formed of a generally rigid impact-resistant durable plastic. The pill bottle has a tubular elongated side wall 14 with an integral inwardly flared and annular curved upper end portion 16 and an integral inwardly flared and annularly curved lower end portion 18. The radius of curvature of the upper end portion is greater than the radius of curvature of the lower end portion. The pill bottle includes a circular planar bottom wall 20 integral with the lower end portion and perpendicularly positioned with respect to the sidewall. The bottom wall is further axially aligned with the side wall. The pill bottle also has a tubular mouth 22 with outwardly projecting threads 26 disposed thereon. The mouth has a top end 28 and a bottom end 30. The bottom end is integral with the upper end portion of the side wall and axially aligned therewith. The mouth defines a central opening (not labeled) for allowing items such as pills to be disposed within the pill bottle.

Also provided is a dispensing cap 40. The dispensing cap is formed of a generally rigid impact-resistant durable plastic. The dispensing cap includes a cap portion 42 in association with a pivotable elongated nozzle 44. The cap portion has a circular planar top wall 46. The top wall has an upper surface 48, a lower surface 50, and a peripheral outer edge 52 interconnecting the upper surface with the lower surface. The cap portion includes an annular side wall 54 projected downwards therefrom. The side wall has an outer surface and an inner surface 56 with a plurality of inwardly projecting threads disposed therearound coupleable with the threads on the mouth of the pill bottle. The side wall also has a top end and a bottom end. The top end is integral and perpendicular with the outer edge of the top wall such that the side wall is axially aligned with the top wall. The top wall further includes an elongated and diametrically aligned linear channel 60 disposed thereon. The length of this channel is less than the exterior diameter of the top wall of the cap portion. The channel defines a planar horizontal base surface (not labeled) and a pair of opposed and spaced upstanding inner side surfaces 64. The side surfaces are extended between the base surface and upper surface of the top wall. The channel also defines an upstanding first end surface 66 and a second end surface. The first end surface is extended between the side surfaces and base surfaces at one end of the channel. The second end surface is extended between the side surfaces and the base surface at the other end of the channel. The second end surface includes an upstanding lower end surface portion 70 and an outwardly flared upper end surface portion 72. The upper end surface portion and the adjacent side surfaces in combination therewith define a shallow slot 74 positioned just below the upper surface of the top wall of the cap portion. A pair of opposed seats 76 are also included and formed as part an integral of the channel. Each seat is disposed on a side surface at a location near the first end surface. Each seat includes a frustral recessed portion 78 and a vertical outwardly tapered groove 80. The groove has a trapezoidal cross-section. The groove is extended from the recessed portion to the upper surface 48 of the top wall. The cap portion further includes a rectangular aperture (not labeled) disposed on and through the base surface of the channel at a location between the seats. The cap portion is threadedly coupled to the mouth portion of the pill bottle with the aperture thereof in communication with the central opening.

The nozzle of the dispensing cap has an upper wall 90 with a planar upper exterior surface 92 and a lower interior surface, a lower wall 94 with an exterior surface and an interior surface, and a pair of opposed spaced side walls 96 each having an exterior surface and an interior surface. The sidewalls are perpendicularly interconnected between the upper wall and lower wall. The nozzle also has a rounded base end 98 with a base opening 100 having a generally rectangular cross-section disposed thereon, a sealed tip end 102, and an intermediate location 104 defined between the base end and tip end. The nozzle is further segmented into a hollow base portion and a hollow tip portion. The hollow base portion 106 has a rectangular cross-section. The base portion is tapered inwards from the base end to the intermediate location 104. The tip portion 108 also has a rectangular cross-section. The tip portion tapers outwards from the intermediate location to the tip end. A tip opening 110 is disposed on the lower surface. The tip opening is formed of a generally rectangular first section 112 located on the base portion and a generally rectangular adjacent second section 114 located on the tip portion. The nozzle includes a planar rectangular lip 116. The lip is projected outwards from the tip end and aligned in parallel with the tip portion 108. Lastly, a pair of opposed and axially aligned plugs 118 are extended oppositely outwards from the side surfaces of the lower portion at a location near the base end. Each plug has a frustral shape. Each plug is disposed through a separate groove of the cap portion and positioned within a recessed portion 78 of a separate seat 76 for rotatable movement therein. When the seats are disposed within the recessed portions, the nozzle is pivotally coupled with the cap portion. The nozzle is positionable in a closed orientation within the channel 60 with its upper surface 92 flush with the upper surface 48 of the cap portion and with its lip 116 positioned in the slot 74 of the cap portion for precluding communication between its base opening 100 and the aperture 82 of the cap portion. In this closed position, items disposed within the pill bottle are prevented from being dispensed through the tip opening 110 of the nozzle in a sequential fashion. The nozzle is further positionable in an open orientation with its base opening in communication with the aperture of the cap portion and the central opening of the pill bottle. In this open position, items disposed within the pill bottle can be dispensed through the tip opening of the nozzle in a sequential fashion.

The present invention is a pill bottle and dispensing cap combination that is easily opened by people who are unable to manipulate those caps which are designed to be child proof. The dispensing cap of the present invention does not require compression and rotation to be opened. It is made of plastic and screwed onto the pill bottle. The dispensing cap need not be opened to remove one or more pills. The pills are dispensed through a nozzle that is hinged to the cap portion. The nozzle faces down and is flush with the top of the cap portion so that it cannot be accidently opened. A lip is provided so that the nozzle can be flipped up with a user's fingernail. Pills or like items cannot flow out of the pill bottle until the nozzle is placed in an upwardly extended orientation.

To obtain a pill from the pill bottle, the pill bottle is placed in an upright position and the nozzle is pulled up to a vertical position. The pill bottle is then tilted, causing the pills to sequentially flow into the nozzle and out the tip opening thereof. After the desired amount of pills are removed, the pill bottle is placed back in the upright position to return any pills remaining in the nozzle to the pill bottle. The nozzle is then pivoted back into the groove by pressing downwards on the lip to seal the pill bottle, thereby preventing pills from being inadvertently dispensed.

Unlike present-day child-proof type caps, if the household permits its use, people who have a great deal of trouble opening bottles will prefer the present invention. Accidental spillage which occurs when a conventional cap suddenly disengages from a conventional bottle will also be avoided. For anyone with arthritis or who has difficulty using their hands, the present invention provides a unique advantage when compared to currently available bottle caps and dispensers.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A pill bottle and dispensing cap combination for allowing an individual to readily dispense pills and the like for use comprising:

a plastic pill bottle having a tubular side wall with an integral inwardly flared annular curved upper end portion and an integral inwardly flared annular curved lower end portion with a radius of curvature of the upper end portion being greater than a radius of curvature of the lower end portion, a circular planar bottom wall integral with the lower end portion and axially aligned with the side wall, and a tubular mouth with outwardly projecting threads disposed thereon having a top end and a bottom end with the bottom end integral with the upper end portion of the side wall and axially aligned with the side wall and with the mouth defining a central opening for allowing items to be disposed within the pill bottle;

a plastic dispensing cap including a cap portion and an elongated nozzle, the cap portion having a circular planar top wall with an upper surface, a lower surface, a peripheral outer edge interconnecting the upper surface with the lower surface, an annular side wall having an outer surface, an inner surface with a plurality of inwardly projecting threads disposed therearound, a top end, and a bottom end with the top end integral and perpendicular with the outer edge of the top wall such that the side wall is axially aligned with the top wall, the top wall further including an elongated diametrically aligned channel disposed thereon with the channel defining a planar horizontal base surface, a pair of opposed and spaced upstanding inner side surfaces with the side surfaces extended between the base surface and upper surface of the top wall, an upstanding first end surface extended between the side surfaces and base surface at one end of the channel, a second end surface extended between the side surfaces and the base surface at the other end of the channel with the second end surface including an upstanding lower end surface portion and an outwardly flared upper end surface portion with the upper end surface portion and the adjacent side surfaces defining a shallow slot, and a pair of opposed seats with each seat disposed on a side surface at a location near the first end surface and with each seat including a frustral recessed portion and an vertical outwardly tapered groove having a trapezoidal cross-section extended therefrom to the upper surface of the top wall, the cap portion further including a rectangular aperture disposed on the base surface of the channel at a location between the seats, the cap portion threadedly coupled to the mouth of the pill bottle with the aperature thereof in communication with the central opening, the nozzle having an upper wall with a planar upper surface, a lower wall, and pair of opposed spaced side walls perpendicularly interconnected therebetween, a rounded base end with a base opening disposed thereon, a sealed tip end projecting substantially orthogonally from the upper wall and terminating a first distance therefrom, an intermediate location defined between the base end and the tip end, a hollow base portion having a rectangular cross-section tapering inwards from the base end to the intermediate location such that the side walls terminate a second distance from the upper wall, with the first distance being substantially greater than the second distance, the lower wall being positioned the first distance from the upper wall proximal to the rounded base end and projecting towards the upper wall to terminate at the intermediate location positioned the second distance from the upper wall, and a hollow tip portion having a rectangular cross-section tapering outwards from the intermediate location to the tip end, a tip opening disposed on the lower surface with the tip opening formed of a generally rectangular first section located on the base portion and a generally rectangular second section located on the tip portion, a planar rectangular lip projected outwards from the tip end and aligned in parallel with the upper wall of the tip portion, and a pair of opposed axially aligned frustral plugs extended oppositely outwards from the side surfaces of the lower portion near the base end and with each plug disposed within a recessed portion of a separate seat for rotatable movement therein, the nozzle positionable in a closed orientation within the channel with its upper surface flush with the upper surface of the cap portion and with its lip is positioned in the slot of the cap portion for precluding communication between its base opening and the aperture of the cap portion and thereby preventing items disposed within the pill bottle from being dispensed through the tip opening of the nozzle, the nozzle further positionable in an open orientation with its base opening in communication with the aperture of the cap portion and the central opening of the pill bottle and thereby allowing items disposed within the pill bottle to be dispensed through the tip opening of the nozzle.

2. A dispensing cap for allowing an individual to readily dispense pills and the like when coupled to a pill bottle comprising a cap portion and an elongated nozzle, the cap portion having a circular planar top wall with an upper surface, a lower surface, a peripheral outer edge interconnecting the upper surface with the lower surface, an annular side wall having an outer surface, an inner surface with a plurality of inwardly projecting threads disposed therearound, a top end, and a bottom end with the top end integral and perpendicular with the outer edge of the top wall such that the side wall is axially aligned with the top wall, the top wall further including an elongated diametrically aligned channel disposed thereon with the channel defining a planar horizontal base surface, a pair of opposed and spaced upstanding inner side surfaces with the side surfaces extended between the base surface and upper surface of the top wall, an upstanding first end surface extended between the side surfaces and base surface at one end of the channel, a second end surface extended between the side surfaces and the base surface at the other end of the channel with the second end surface including an upstanding lower end surface portion and an outwardly flared upper end surface portion with the upper end surface portion and the adjacent side surfaces defining a shallow slot, and a pair of opposed seats with each seat disposed on a side surface at a location near the first end surface and with each seat including a frustral recessed portion and an vertical outwardly tapered groove having a trapezoidal cross-section extended therefrom to the upper surface of the top wall, the cap portion further including a rectangular aperture disposed on the base surface of the channel at a location between the seats, the cap portion threadable to a mouth of the pill bottle, the nozzle having an upper wall with a planar upper surface, a lower wall, and pair of opposed spaced side walls perpendicularly interconnected therebetween, a rounded base end with a base opening disposed thereon, a sealed tip end projecting substantially orthogonally from the upper wall and terminating a first distance therefrom, an intermediate location de fined between the base end and the tip end, a hollow base portion having a rectangular cross-section tapering inwards from the base end to the intermediate location such that the side walls terminate a second distance from the upper wall, with the first distance being substantially greater than the second distance, the lower wall being positioned the first distance from the upper wall proximal to the rounded base end and projecting towards the upper wall to terminate at the intermediate location positioned the second distance from the upper wall, and a hollow tip portion having a rectangular cross-section tapering outwards from the intermediate location to the tip end, a tip opening disposed on the lower surface with the tip opening formed of a generally rectangular first section located on the base portion and a generally rectangular second section located on the tip portion, a planar rectangular lip projected outwards from the tip end and aligned in parallel with the upper wall of the tip portion, and a pair of opposed axially aligned frustral plugs extended oppositely outwards from the side surfaces of the lower portion near the base end and with each plug disposed within a recessed portion of a separate seat for rotatable movement therein, the nozzle positionable in a closed orientation within the channel with its upper surface flush with the upper surface of the cap portion and with its lip is positioned in the slot of the cap portion for precluding communication between its base opening and the aperture of the cap portion, the nozzle further positionable in an open orientation with its base opening in communication with the aperture of the cap portion.

* * * * *